United States Patent [19]

Drop et al.

[11] 4,195,253

[45] Mar. 25, 1980

[54] METHOD OF AGEING A GAS DISCHARGE LAMP

[75] Inventors: Peter C. Drop; Walter J. R. de Rop; Robert L. M. E. Maes, all of Eindhoven, Netherlands

[73] Assignee: U.S. Philips Corporation, New York, N.Y.

[21] Appl. No.: 877,164

[22] Filed: Feb. 13, 1978

Related U.S. Application Data

[63] Continuation of Ser. No. 745,957, Nov. 29, 1976, abandoned.

[30] Foreign Application Priority Data

Dec. 4, 1975 [NL] Netherlands ..... 7514124

[51] Int. Cl.[2] ..... H01J 9/44

[52] U.S. Cl. ..... 316/1; 316/26

[58] Field of Search ..... 316/1, 26; 313/201

[56] References Cited

U.S. PATENT DOCUMENTS

| | | | |
|---|---|---|---|
| 1,965,582 | 7/1934 | Foulke | 313/262 X |
| 2,800,622 | 7/1957 | Lion | 313/248 X |
| 2,925,564 | 2/1960 | Shahbender | 313/201 X |

OTHER PUBLICATIONS

"Dictionary of Electronics," by Radio Shack, p. 265.

*Primary Examiner*—Richard B. Lazarus

*Attorney, Agent, or Firm*—Robert S. Smith

[57] ABSTRACT

A method for ageing a gas discharge lamp which is provided with a vacuum-tight sealed light-transmissive discharge vessel in which at least two electrodes are disposed and which contains a gas filling. A high-frequency glow discharge is produced in the discharge vessel during a given length of time. The frequency of this discharge preferably has a value between 1 kHz and 100 MHz and the discharge is preferably maintained for 1 to 120 seconds. Ageing results in a considerable reduction in the starting voltage of the lamp.

6 Claims, 2 Drawing Figures

METHOD OF AGEING A GAS DISCHARGE LAMP

This is a division of application Ser. No. 745,957, filed Nov. 29, 1976 now abandoned.

The invention relates to a method of ageing a gas discharge lamp which is provided with a vacuum-tight sealed light transmissive discharge vessel in which at least two electrodes are disposed and which contains a gas filling. Furthermore the invention relates to discharge lamps obtained with such a method.

So-called ageing is a common practice in the manufacture of gas discharge lamps which takes place at the end of the manufacturing process of the lamps when the discharge vessel has already been sealed vacuum-tight and provided with the electrodes and the desired gas filling. Prior to or after ageing the discharge vessel may, if so desired be placed in an outer bulb. Ageing conditions and stabilizes the operating properties of the lamp. Particularly, ageing reduces the starting voltage of the lamp to the desired level.

The prior art method of ageing of, for example, high-pressure gas discharge lamps, consists of burning the lamp either at the nominal operating voltage and lamp current or with a load larger than the load calculated for normal burning, for a relatively long time, for example for 5 minutes to some hours, (see U.S. Pat. Nos. 2,249,605 and 3,682,525).

A disadvantage of the prior art methods of ageing is the length of time of this manufacturing step. In general this is many times longer than the other manufacturing steps so that ageing cannot be done at the rate of the machine which produces the lamps. In particular ageing cannot be done on this machine itself. Consequently it must be done in a separate apparatus, for example a so-called ageing rack in which a plurality of lamps can be processed simultaneously. This time-consuming method is expensive and labour intensive.

U.S. Pat. No. 1,965,582 discloses a method for producing gas discharge lamps in which, as one of the manufacturing steps, a high frequency arc discharge of some amperes for approximately 30 seconds between the electrodes of the sealed discharge vessel is mentioned. This high-frequency arc discharge raises the electrodes to a high temperature and has for its object to activate the electrodes. After this processing of the electrodes the lamps must be aged for several minutes more in order to obtain a low starting voltage.

The object of the invention is to provide a method of ageing gas discharge lamps which does not have the disadvantages of the prior art methods and which can be performed in a considerably shorter time.

SUMMARY OF THE INVENTION

A method according to the invention for ageing a gas discharge lamp which is provided with a vacuum-tight sealed, light transmissive discharge vessel in which at least two electrodes are disposed and which contains a gas filling, a discharge being produced in the discharge vessel for a given period of time, is characterized in that this discharge is a high-frequency glow discharge.

It has been found that maintaining a glow discharge for a given period of time in the gas filling of the discharge vessel of a gas discharge lamp whose starting voltage is too high, results in a considerable reduction in the starting voltage level of the lamp so that the effect aimed at by ageing is obtained. As, in practice there are objections against producing a d.c. or low frequency glow discharge in the gas filling of a lamp a high-frequency glow discharge must be used in a method according to the invention. Frequencies exceeding, for example, 100 Hz are eligible for use. Suprisingly it was found that high-frequency ageing according to the invention by means of a glow discharge takes only very little time. If the discharge is maintained for, for example, 0.1 sec. a considerable reduction of the starting voltage is already obtained. Furthermore it was found that ageing by means of high frequency are discharges is indeed possible but that in order to achieve the desired effect such an arc discharge must be maintained for substantially the same time as required for prior art ageing by means of normal burning of the lamp.

A method according to the invention has the advantage that it can be performed in a very short time so that ageing may be done at a rate equal to or even greater than the rate at which the machine produces the lamp. A further advantage is that ageing according to the invention results in a saving of energy compared to the prior art methods.

With a method according to the invention the frequency of the glow discharge may be chosen within very wide limits. The upper limit of the frequency is in practice only determined by prevailing requirements as regards safety, radio interference and such like. Preference is given to methods according to the invention in which the frequency of the discharge has a value between 1 kHz and 100 MHz, more in particular between 0.1 and 50 MHz. With these frequencies the best results are obtained with simple equipment as regards reducing the discharge voltage level within a short period of time.

The time during which the discharge is maintained, when ageing according to the invention, depends on the required reduction in the discharge voltage, on the size of the discharge lamp to be aged, and on the output of the high frequency generator to be used. In general it is possible to obtain the results aimed at in time periods of 1 to 120 seconds. With a method according to the invention these lengths of time are therefore preferred.

With a method according to the invention it is possible to connect a high-frequency voltage source to the electrodes of the discharge lamp so that the high-frequency glow discharge is the gas filling of the discharge vessel is maintained via the electrodes. However, preference is given to a method according to the invention in which the high-frequency glow discharge is fed from a high frequency voltage source which comprises two high-frequency electrodes and in which the electrical coupling between these high-frequency electrodes and the gas filling in the discharge vessel takes place via the wall of the discharge vessel. Operating the glow discharge in this manner, also called electrodoless discharge, has the advantage that it is easy to mechanize the method because the lamps need not make direct contact with the high-frequency electrodes. Furthermore, in this manner blackening of the discharge vessel which may occur to a slight degree when applying the high-frequency voltage via the electrodes of the lamp is practically excluded.

With a method in which the above-described electrodeless discharge is used, the high-frequency electrodes may be in the shape of two metal brackets or clamps which are placed interspaced around the discharge vessel of the lamps. However, preference is given to a method according to the invention in which at least one of the high-frequency electrodes is in the form of a metal plate and the other high frequency electrode is arranged at such a distance from this plate that the lamp can be passed between these two electrodes. The other high-frequency electrode may, for example, also be a metal plate which is arranged parallel with the first electrode. This preferred embodiment of the method has the advantage that a large plurality of lamps can be placed simultaneously between the high-frequency electrodes. In this method it is also possible to pass the lamps continuously between the electrodes at a desired rate, for example equal to the production rate of the lamp machine; the dimensions of the electrodes having been chosen such that the period of time the lamps remain between those electrodes is of a length which is suitable for ageing.

Preference is given to a method in which high-pressure mercury vapour discharge lamps are aged. When producing this kind of lamps, large number of lamps are frequently obtained which initially have too high a starting voltage. With a method according to the invention the starting voltage level of these lamps can be brought in a simple manner and in a short time to the desired value.

DETAILED DESCRIPTION OF THE PREFERRED EMBODIMENT

Figure 1:
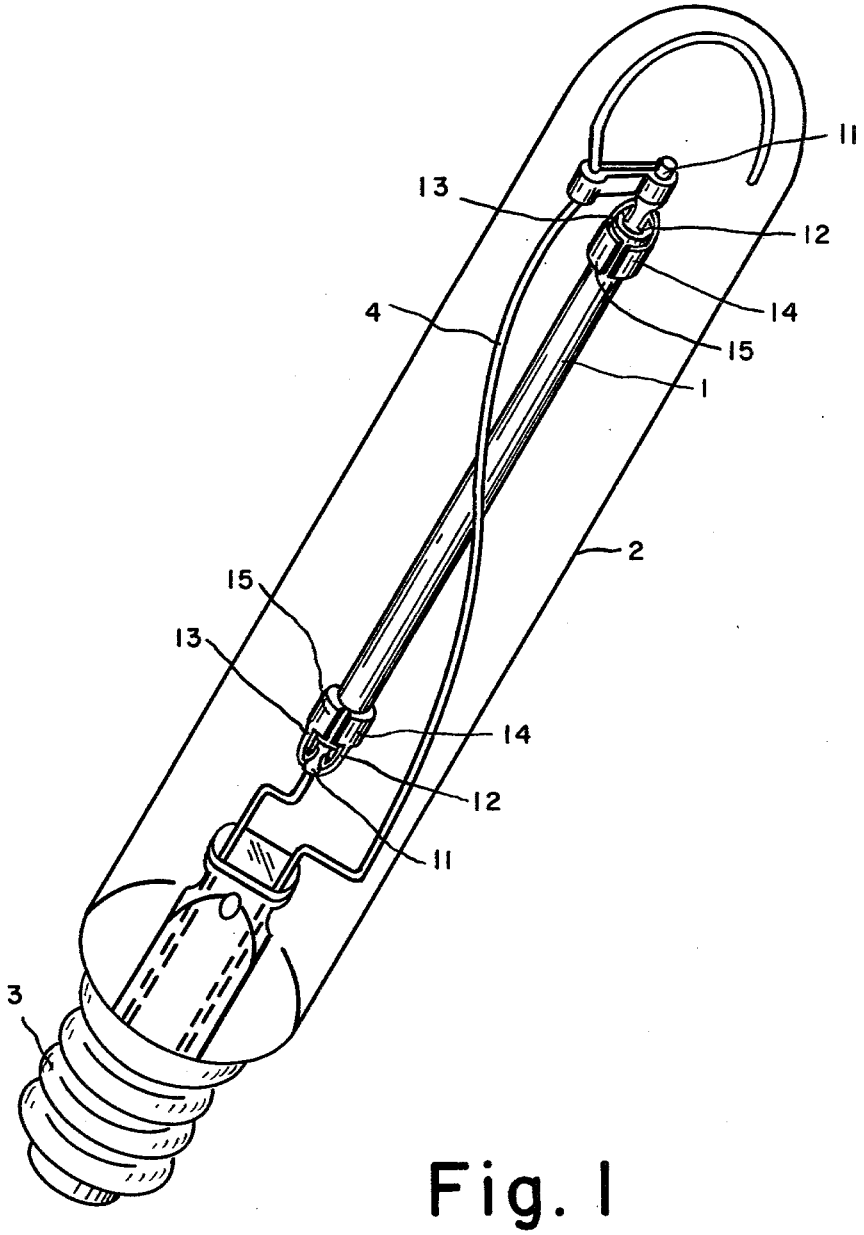
FIG. 1 is a perspective view of a discharge lamp which may aged in accordance with one form of the invention.

FIG. 1 is a perspective view of a discharge lamp according to the invention. FIG. 1 shows a high-pressure sodium vapour discharge lamp of the type which may be aged in accordance with the invention. A discharge tube is enveloped by an outer bulb 2 with a lamp cap 3. Both ends of the discharge tube 1 have been provided with an auxiliary device which is fitted with bimetal strips 12, 13 and heat shields 14, 15 which are described in greater detail in U.S. application Ser. No. 653,432 filed Jan. 29, 1976. The auxiliary devices used need not be incorporated in the lamps which are aged in accordance with the present invention.

The invention will now be further explained with reference to the embodiments.

Figure 2:
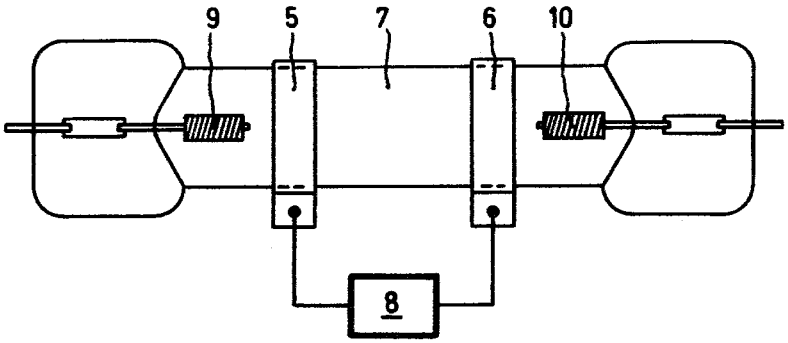
FIG. 2 is an elevational view of another discharge lamp and the apparatus for ageing that lamp.

Referring now to FIG. 2 high-pressure mercury vapour discharge lamps, intended, for connection during operation to a voltage of 220 volts and for consuming a power of 80 W, are produced in a customary manner, starting from a quartz glass tube having an outside diameter of approximately 10 mm and an inside diameter of approximately 8 mm. An electrode 9, 10 is disposed at both ends of these tubes (distance between the tops of the electrodes approximately 22 mm) and sealed vacuum-tight by means of a pinch seal. The discharge vessels formed in this way, which are still connected to the environment by means of an exhaust tube, are thereafter degassed and evacuated. Thereafter the gas filling, consisting of a quantity of mercury which fully evaporates during operation of the lamp and also of argen to a pressure of some dozens of torr is passed into the discharge vessel whereafter the discharge vessel is sealed off. The discharge vessels thus obtained are manufactured into lamps by placing them in a glass outer bulb which is either evacuated or filled with inert gas. There lamps must satisfy the requirement that they ignite when a voltage of not more than 180 V is applied. If no further measures are taken, the majority of the lamps do not satisfy this requirement. In accordance with the invention the discharge vessels (prior to being built into the outer bulb) are aged by generating a high frequency glow discharge in the gas filling. To that end two metal brackets 5, 6 are applied around the discharge vessel at a mutual spacing of approximately 1 cm. The output terminals of a high frequency voltage generator 8 (1 MHz; 1250 V) are connected to these brackets 5, 6 which causes an electrodeless glow discharge (current strength some dozens of mA) in the discharge vessel. The power dissipated in this glow discharge is low so that the gas filling in the discharge vessel is only heated a little and the discharge takes place in rare gas having low pressure. The glow discharge is maintained for 30 seconds. It was found that nearly all discharge vessels which are aged in this manner started at voltages below 170 V. So far it has only been possible to obtain a similar result with these discharge lamps by burning the lamps for 6 minutes at 1.5 times the nominal operating current.

Substantially the same result can be achieved with the above described discharge tubes which are intended for 80 W lamps by passing the discharge tubes continuously between two parallel disposed metal plates (dimensions $10\times 10$ cms). At any moment approximately 6 discharge tubes are present between the plates and each tube stays approximately 10 seconds between the plates. A high-frequency voltage (80 MHz) is applied to the plates so that a glow discharge (current strength approximately 100 mA) is generated in the discharge vessels.

What is claimed is:

1. A method for reducing the starting voltage in an arc discharge lamp which comprises: an arc discharge lamp providing lamp having a vacuum-tight sealed light-transmissive discharge vessel in which at least first and second electrodes are disposed and which contains a gas filling, and producing a high frequency glow discharge in said discharge vessel for a finite time interval.

2. A method as claimed in claim 1 wherein said high frequency glow in said discharge vessel has a value between 1 kHz and 100 MHz.

3. A method as claimed in claim 1 wherein said discharge is maintained between 1 and 120 seconds.

4. A method as claimed in claim 1 wherein said producing step includes providing a high frequency voltage source which comprises third and fourth electrodes which are high-frequency electrodes and said third and fourth electrodes are positioned outside of said discharge vessel proximate to the wall of the discharge vessel without physical connection to any of said first and second electrodes.

5. A method as claimed in claim 4 wherein each of said third and fourth electrodes is a metal plate and said fourth electrode is disposed at a distance from said third electrode greater than at least one outer dimension of the gas discharge lamp being aged.

6. A method as claimed in claim 5 wherein said arc discharge lamp in said providing step is a high-pressure mercury vapour discharge lamp.

* * * * *

UNITED STATES PATENT OFFICE

CERTIFICATE OF CORRECTION

Patent No. 4,195,253 Dated March 25, 1980

Inventor(s) PETER C. DROP et al

It is certified that error appears in the above-identified patent and that said Letters Patent are hereby corrected as shown below:

Col 4, line 37, After "comprises:" insert --providing--

Col 4, line 38, After "lamp" (first occurrence)

delete "providing lamp"

Signed and Sealed this

*Thirteenth* Day of *January 1981*

[SEAL]

*Attest:*

SIDNEY A. DIAMOND

*Attesting Officer*

*Commissioner of Patents and Trademarks*